United States Patent [19]

Oswell

[11] 4,273,120

[45] Jun. 16, 1981

[54] UNDERWATER BREATHING APPARATUS

[75] Inventor: Hugh H. B. Oswell, Hexham, England

[73] Assignee: Submarine Products Limited, Northumberland, England

[21] Appl. No.: 15,741

[22] Filed: Feb. 27, 1979

[30] Foreign Application Priority Data

Feb. 27, 1978 [GB] United Kingdom ..... 7728/78

[51] Int. Cl.[3] ..... A62B 7/00

[52] U.S. Cl. ..... 128/204.26; 128/205.12; 128/205.24

[58] Field of Search ..... 128/142 R, 142.2, 142 G, 128/142.3, 147, 210, 201.11, 204.26, 205.12, 205.24, 204.28

[56] References Cited

U.S. PATENT DOCUMENTS

| | | | |
|---|---|---|---|
| 2,488,261 | 11/1949 | Bedini | 128/142 R |
| 2,844,145 | 7/1958 | Berge | 128/147 |
| 3,051,170 | 8/1962 | Benzel | 128/147 |
| 3,111,946 | 11/1963 | Galeazzi | 128/147 |

FOREIGN PATENT DOCUMENTS

| | | | |
|---|---|---|---|
| 580386 | 1/1955 | Canada | 128/147 |
| 1382022 | 11/1964 | France | 128/142.2 |
| 562239 | 5/1957 | Italy | 128/147 |
| 606001 | 6/1960 | Italy | 128/147 |
| 447119 | 5/1936 | United Kingdom . | |
| 493122 | 12/1936 | United Kingdom . | |
| 626872 | 7/1949 | United Kingdom | 128/145 A |
| 1358303 | 7/1974 | United Kingdom . | |
| 513703 | 8/1976 | U.S.S.R. | 128/142 R |

*Primary Examiner*—Henry J. Recla

*Attorney, Agent, or Firm*—Birch, Stewart, Kolasch & Birch

[57] ABSTRACT

The present invention is directed to a closed circuit underwater breathing apparatus having a mouthpiece and an outward and return connection leading from the mouthpiece to an inflatable breathing bag and back respectively to form a breathing circuit. A carbon dioxide absorbent is arranged in the breathing circuit. In use, exhaled gases flow from the mouthpiece through the outward connection to expand the breathing bag and then, on inhalation, they return from the breathing bag through the return connection to the mouthpiece. The apparatus also includes a demand valve controlling a connection between the mouthpiece and an inlet for an attachment to a supply of breathable gas. The demand valve so operates automatically to open the connection between the inlet and the mouthpiece when inhalation demand through the mouthpiece is not completely satisfied by the gases from the breathing bag so that the inlet connected to a supply of breathable gas is opened and the operation of the demand valve allows sufficient gas from the supply of breathable gas to enter the mouthpiece to complete the satisfaction of inhalation demand.

13 Claims, 6 Drawing Figures

UNDERWATER BREATHING APPARATUS

The invention relates to a closed-circuit underwater breathing apparatus of the kind comprising a mouthpiece and outward and return connections leading from the mouthpiece to an inflatable breathing bag and back respectively to form a breathing circuit. A carbon dioxide absorbent is arranged in the breathing circuit. In use, exhaled gases flowing from the mouthpiece through the outward connection expand the breathing bag, then, on inhalation, as the gases pass from the breathing bag through the return connection to the mouthpiece for inhalation, the carbon dioxide absorbent removes carbon dioxide from the gases during their passage around the breathing circuit. A non-return valve system is included in the breathing circuit preventing reverse flow around the circuit, hereinafter called apparatus of the kind referred to.

BRIEF DESCRIPTION OF THE PRIOR ART

Apparatus of the kind referred to requires some further supply of breathable gas to make up the oxygen absorbed in use during breathing and thus satisfy inhalation demand. A known apparatus of the kind referred to uses for this purpose an oxygen supply connected to the breathing bag by a manually operable valve which when opened admits additional oxygen into the breathing bag. Another known apparatus of the kind referred to uses a supply of oxygen connected to the breathing bag by a constant mass-flow valve which supplies oxygen to the breathing bag at a rate substantially equal to that at which oxygen is used during breathing.

SUMMARY AND OBJECTS OF THE INVENTION

An object of the invention is to provide an improved apparatus of the kind referred to.

According to the invention there is provided a closed circuit breathing apparatus of the kind referred to and further comprising a demand valve controlling a connection between the mouthpiece and an inlet for attachment to a supply of breathable gas, the demand valve so operating automatically to open the connection between the inlet and the mouthpiece when inhalation demand at the mouthpiece is not completely satisfied by the gases from the breathing bag. In use, with the inlet connected to a supply of breathable gas, the operation of the demand valve allows sufficient gas from the supply of breathable gas to enter the mouthpiece to complete the satisfaction of inhalation demand.

An apparatus according to the invention has the advantage that the automatic response of the demand valve requires no control by the breather to make up the supply of oxygen. The demand valve will respond automatically to increases in depth.

There may be provided a manually operable control valve between the mouthpiece and the outward and return connections. The control valve, in a first position, connecting the mouthpiece to the outward and return connections to allow closed circuit breathing and, in a second position, disconnecting the mouthpiece from the outward and return connections and connecting the mouthpiece to a one-way exhaust valve to allow gas from a supply of breathable gas connected to the inlet to be inhaled through the mouthpiece and exhaled through the exhaust valve.

The apparatus may include a supply of breathable gas connected to the inlet.

The supply of breathable gas may be a supply of oxygen, a first shut-off valve being provided for halting the supply of oxygen to the demand valve and a second shut-off valve being provided which controls a connection between the breathing bag and a supply of an oxygen/helium mixture included in the apparatus separate from the supply of oxygen. In use, initial descent from the surface can be made with the first shut-off valve open and the second shut-off valve closed to allow oxygen from the supply of oxygen to be inhaled and then, when the partial pressure of the oxygen is too great for breathing or at a predetermined depth, the first shut-off valve can be closed to discontinue the oxygen supply and the second shut-off valve be opened to admit the oxygen/helium mixture into the breathing bag at a steady rate of supply, exhalation and inhalation then being to and from the breathing bag, with oxygen deficiencies being replenished by the supply of the oxygen/helium mixture to the breathing bag, the sequence of operation being reversed on ascent.

BRIEF DESCRIPTION OF THE DRAWINGS

The following is a more detailed description of two embodiments of the invention, by way of example, reference being made to the accompanying drawings in which.

DETAILED DESCRIPTION OF THE INVENTION

Figure 1:
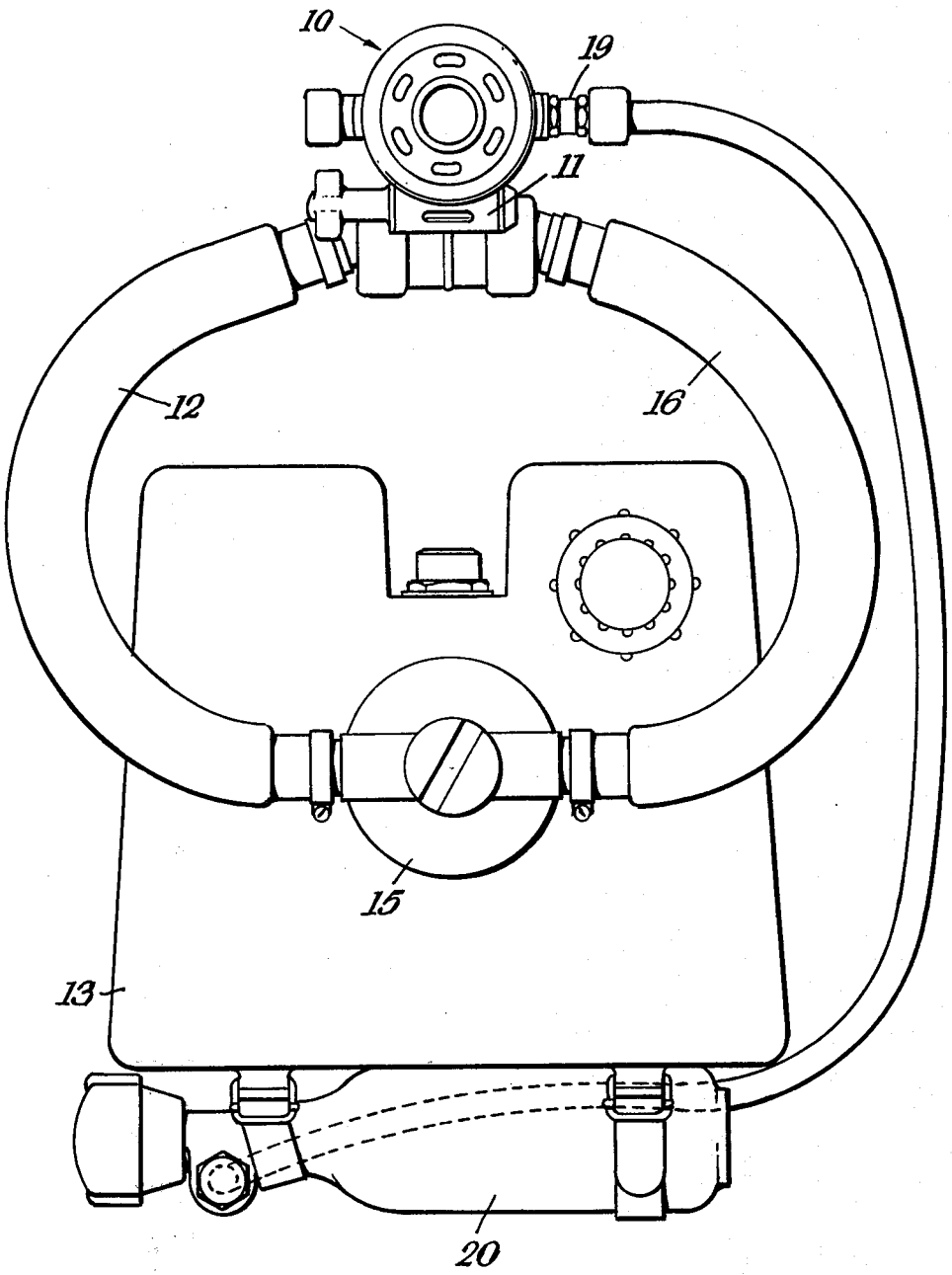
FIG. 1 is a front elevation of a first embodiment of a closed-circuit breathing apparatus.
Figure 2:
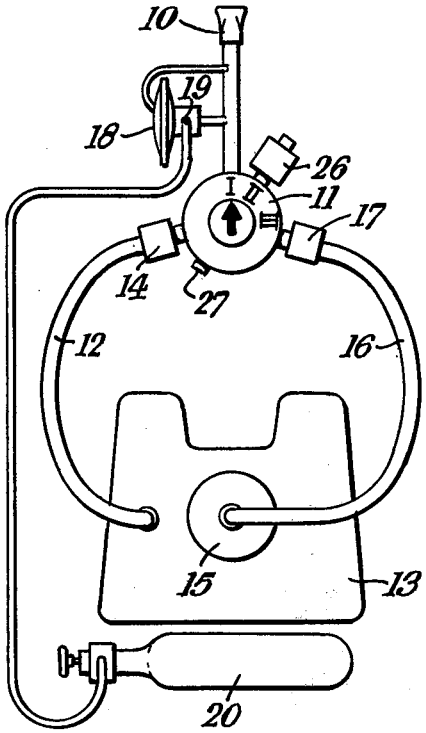
FIG. 2 is a schematic view of the apparatus of FIG. 1, FIGS. 3, 4 and 5 are schematic cross-sectional views of a three-position value of the apparatus of FIGS. 1 and 2, each figure showing a different one of the three positions of the valve.

Referring first to FIGS. 1 and 2, the apparatus comprises a mouthpiece 10 connected by a control valve 11, whose operation is described in more detail hereinafter, to one end of an outward connection pipe or flow conduit 12 whose other end is connected to an inflatable rubber breathing bag 13. The outward connection pipe 12 includes a non-return valve 14 (see FIG. 2) which permits flow only in a direction from the mouthpiece 10 to the breathing bag 13.

An outlet from the breathing bag 13 leads into a canister of a carbon dioxide absorbent 15 carried on the breathing bag 13. A return connection pipe or flow conduit 16 leads from the canister 15 to the control valve 11 and includes a non-return valve 17 which permits flow only in a direction from the canister 15 to the control valve 11.

The mouthpiece 10 includes a demand valve 18 of known type which is described in more detail hereinafter. The demand valve 18 has an inlet flow conduit 19 connected to a cylinder 20 of a breathable gas under pressure the breathable gas being oxygen or air, or an oxygen/nitrogen mixture, or an oxygen/helium mixture. In the case of an oxygen/helium mixture, the oxygen may be present in the mixture to give the same partial pressure as the partial pressure of oxygen in atmospheric air at the required operating depth.

Figure 3:
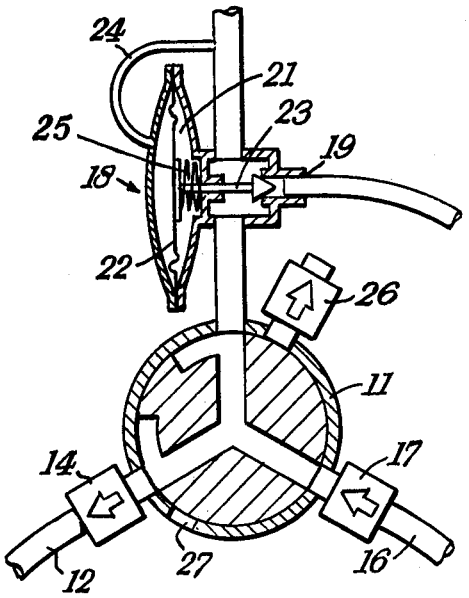
Figure 4:
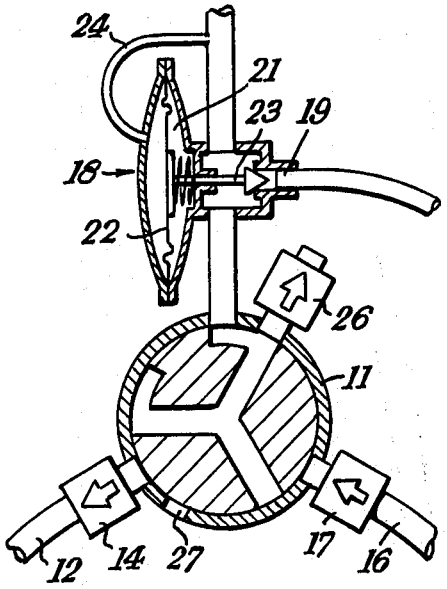
Figure 5:
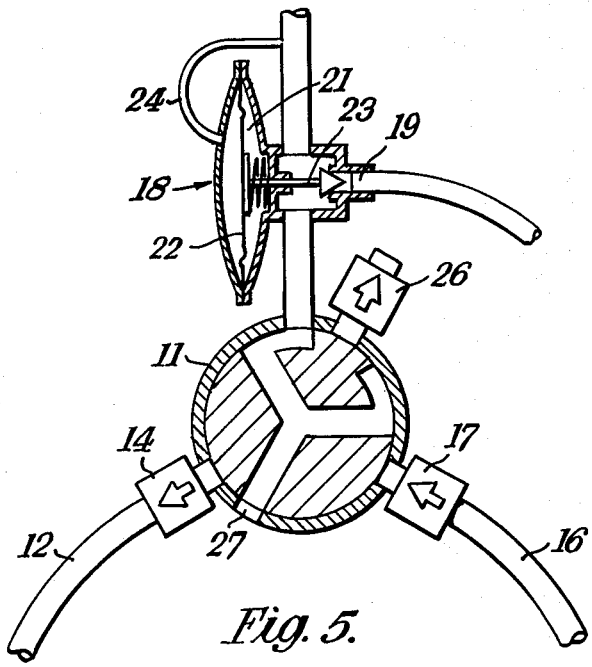

Referring now to FIGS. 3 to 5, the demand valve 18 includes a chamber 21 divided by a diaphragm 22. A needle valve 23 is connected to the diaphragm 22. A part of the chamber 21 on that side of the diaphragm 22 opposite the valve 23 is connected by a tube 24 to the mouthpiece and the pressure of the air in this part of the chamber on the diaphragm is counteracted by a spring 25, such that under normal breathing conditions the needle valve 23 closes the inlet 19. However, when the pressure of air in the mouthpiece falls, the pressure of air in this part chamber reduces, thus allowing the spring 25 to move the diaphragm 22, so moving the needle valve 23 and opening the inlet flow conduit 19 to admit oxygen into the mouthpiece from the supply of oxygen 20.

The control valve 11 is manually operable and has three working positions which are shown in FIGS. 3, 4 and 5. The first position is shown in FIG. 3 and, in this position, the interior of the mouthpiece 10 is connected to the outward connection pipe 12 and the return connection pipe 16 through the respective non-return valves 14, 17. In the second position, shown in FIG. 4, the interior of the mouthpiece 10 is connected to a one-way exhaust valve 26, and is disconnected from the outward connection pipe 12 and the return connection pipe 16. In the third position, shown in FIG. 5, the mouthpiece 10 is connected directly to the exterior atmosphere through a port 27 and is disconnected from the outward and return connection pipes 12, 16, and from the one-way exhaust valve 26. The use of this valve 11 will be described in more detail hereinafter.

In use, the apparatus is donned by a diver above the surface of the water in which he is to dive. The mouthpiece 10 is placed in the mouth with the control valve 11 in its third position so that the diver can breathe atmospheric air directly and thus not waste any of the supply of breathable gas. The cylinder 20 of breathable gas is, however, open to supply breathable gas under reduced pressure to the inlet 19 of the demand valve 18.

On entering the water the diver moves the control valve 11 to either the first position (FIG. 3) or second position (FIG. 4).

If the first position of the control valve 11 is chosen, exhaled gases pass from the mouthpiece 10 through the non-return valve 14 and the outward connection pipe 12 to inflate the breathing bag 13. The construction of the non-return valve is such that any water or moisture in the mouthpiece is prevented from passing down the outward connection pipe 12 to the breathing bag 13. This can be important where such water or moisture would react with the carbon dioxide absorbent in the canister 15. The demand valve 18 does not operate because the pressure of gas in the mouthpiece 11 is greater than the operating pressure of the demand valve 18.

On inhalation, gases are withdrawn from the breathing bag 13 and passed through the canister 15 where the carbon dioxide in the gases is removed. The carbon dioxide depleted gases then pass from the canister 15 through the return connection pipe 16 and its associated non-return valve 17 to the mouthpiece 18, from which they are inhaled. No gas will be drawn from the outward connection pipe 12 because of the non-return valve 14. The demand valve 18 will not operate provided there is a sufficient supply of gas from the breathing bag 13 to satisfy completely the inhalation demand of the diver. However, when there is any deficiency caused by the oxygen in the gas being used in the diver's body and the diver's demand exceeds the supply from the breathing bag 13, the pressure in the mouthpiece 10 will be reduced below the operating level of the demand valve 18. Thus the demand valve 18 will operate to connect the interior of the mouthpiece 10 to the cylinder 20 of breathable gas and the deficiency will be made up with breathable gas.

The diver can continue to dive with the control valve 11 in this first position and breathing on the closed circuit so formed within the limitations of depth imposed by the breathable gas. The demand valve 18 will respond automatically to increases of depth to make up the supply of breathable gas.

If the second position of the control valve 11 is chosen, exhaled air will pass through the one way exhaust valve 26 into the surrounding water. On inhalation, there will immediately be a pressure drop in the mouthpiece 10 since the mouthpiece is no longer connected to the breathing bag 13. Thus, the demand valve 18 will operate to connect the mouthpiece to the supply of breathable gas and the diver will inhale the breathable gas from the cylinder 20 as with a conventional open-circuit apparatus. When the diver reaches a depth at which the partial pressure of oxygen in the supply of breathable gas is too great for breathing, which normally occurs at a depth of 9–12 meters, the diver moves the control valve 11 from the second position (FIG. 4) to the first position (FIG. 3). The apparatus will then operate on closed-circuit in the manner described above with reference to the drawings, and will allow the diver increased endurance down to depths limited by the breathing mixture used.

The demand valve 18 will respond immediately to increases in the depth of the diver and supply extra breathable gas to maintain the contents of the breathing bag 13 without any action on the part of the diver. The control valve 11 can be moved from the first position to the second position easily should there by a malfunction of the closed circuit part of the apparatus, so that the diver immediately operates on open circuit, drawing breathable gas from the cylinder 20.

The advantage of closed-circuit under-water breathing apparatus over open-circuit under-water breathing apparatus is that whereas, in the open-circuit apparatus, only a part of the oxygen breathed in at each inhalation is used in the diver's body and the remainder exhaled, in a closed-circuit apparatus there is no such wastage of oxygen, and thus the diver is given greatly increased endurance under water, which is limited by the saturation of the carbon dioxide absorbent 15 or by the quantity of breathable gas in the cylinder 20.

Figure 6:
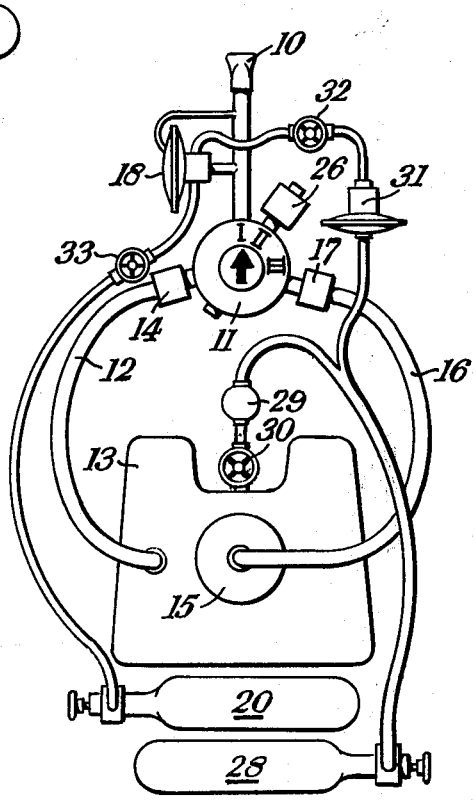
FIG. 6 is a schematic view of a second embodiment of a closed-circuit breathing apparatus.

In diving to depths greater than 50 meters, an oxygen/helium mixture is required which has less than 20% oxygen. Such a mixture is not breathable on the surface as the partial pressure of the oxygen in the mixture is insufficient, although the mixture can be breathed from depths of about 20 meters downwards. Referring now to FIG. 6, the second embodiment shows the use of an oxygen/helium mixture in the apparatus disclosed above with reference to FIGS. 1 to 5, parts common to FIGS. 1 to 5 and to FIG. 6 being given the same reference numerals and not being described in detail. The apparatus includes a cylinder 20 of an oxygen/helium mixture, which is connected through a constant mass flow valve 29 and a shut-off valve 30 to the breathing bag 13 and through depth sensitive valve 31 and a further shut-off valve 32 to the inlet to the demand valve 18. In this apparatus, oxygen fills the cylinder 20 of breathable gas, and a shut-off valve 33 is provided between the oxygen cylinder 20 and the demand valve 18.

As the diver wearing the apparatus enters the water the oxygen/helium shut-off valves 30 and 32 are closed and the control valve 11 is either in the first position for closed-circuit breathing from the breathing bag 13 or in the second position for open-circuit breathing of pure oxygen from the cylinder 20. These forms of breathing can be used until the diver reaches a depth of about 10 meters. At this depth, the oxygen supply is terminated by the shut-off valve 33 and the further oxygen/helium shut-off valve 32 is open to connect the oxygen/helium mixture to the demand valve 18. With the valve 11 in the second position, this mixture is breathed on open circuit until a depth of about 20 meters is reached. Below depths of 20 meters, the further shut-off valve 32 is closed and the first oxygen/helium shut-off valve 30 is opened and the valve 11 is moved to the first position so that breathing takes place through the breathing bag 13 with deficiences in the supply of oxygen being made up from the oxygen/helium mixture. The constant mass flow valve 29 delivers the oxygen/helium mixture to the breathing bag 13 at a rate which substantially equals the rate at which oxygen is used up by the diver.

As the diver ascends and decompresses, this procedure is reversed. This has the advantage that for the last 10 meters of his decompression ascent, the diver is breathing pure oxygen. The use of oxygen in decompression greatly speeds up the process of removal of either nitrogen or helium from the bloodstream due to the very much lower partial pressure of these gases existing in the breathing circuit. The further cylinder 28 may be filled with air or an oxygen/nitrogen mixture or other breathable gas mixtures, depending on depth requirements.

It will be appreciated that one or more of the shut-off valves 30, 32 or 33 may be operated automatically by hydrostatic pressure at a pre-determined depth. The shut-off valve 32 may, for example, remain open with the connection between the cylinder 28 and the demand valve 18 being controlled by the pressure sensitive valve 31.

It will also be appreciated that the constant mass flow valve 29 may be replaced by any device which maintains a correctly constituted breathable mixture in the breathing bag 13 for the depth at which the diver is working.

I claim:

1. A closed circuit breathing apparatus for use by an individual comprising:

a mouthpiece operatively connected to an outward flow conduit and return flow conduit, said outward and return flow conduits being operatively connected to an inflatable breathing bag;

a control valve operatively connected to said mouthpiece;

a gas flow path between said mouthpiece and the control valve;

absorbent means for removing carbon dioxide being operatively connected between said outward and return flow conduits and disposed substantially within said inflatable breathing bag;

a breathing circuit being formed on exhalation between said outward flow conduit and said inflatable breathing bag and on inhalation between said inflatable breathing bag and said return flow conduit, said absorbent means being operatively positioned within said breathing circuit for removing carbon dioxide from exhaled gases;

a one-way exhaust valve operatively connected to said control valve;

said control valve being operatively connected to the said outward and return flow conduits and to said gas flow path, said control valve including a valve member movable between a first position in which the control valve connects the mouthpiece to the outward and return flow conduits to allow closed circuit breathing and a second position in which the control valve disconnects the mouthpiece from the outward and return flow conduits and connects the mouthpiece to said one-way exhaust valve to allow gas to be exhaled through the exhaust valve;

a supply of breathable gas;

an inlet flow conduit operatively connected to said supply of breathable gas;

a connection between said inlet flow conduit and said gas flow path; and a demand valve in said connection for controlling the flow of breathable gas from the inlet flow conduit to the mouthpiece.

2. An apparatus according to claim 1, wherein the control valve includes a vent port and the valve member is movable to a third position in which the mouthpiece is connected to the vent port only, to permit breathing of atmospheric air.

3. An apparatus according to claim 1, wherein the breathable gas is a gas selected from the group consisting of oxygen, air, an oxygen/helium mixture, an oxygen/nitrogen mixture, or an oxygen/helium/nitrogen mixture.

4. A closed circuit breathing apparatus for use by an individual and comprising:

an inflatable breathing bag;

absorbent means located within the bag for removing carbon dioxide from the gas within the breathing bag;

a mouthpiece;

a control valve;

a gas flow path between the mouthpiece and the control valve;

an outward flow conduit operatively connecting the control valve and the breathing bag for gas to flow along the conduit from the control valve to the bag upon exhalation of gas by the individual through the mouthpiece and along the gas flow path to the control valve;

a return flow conduit operatively connecting the control valve and the breathing bag for gas to flow along the conduit from the bag to the control valve upon inhalation of gas by the individual from the control valve along the gas flow path and through the mouthpiece;

a one-way exhaust valve operatively connected to the control valve;

a valve member in the control valve, movable between a first position in which it connects the gas flow path to the outward and return flow conduits to allow closed circuit breathing and a second position in which it disconnects the gas flow path from the outward and return flow conduits and connects the gas flow path to the one-way exhaust valve to allow gas to be exhaled through the exhaust valve;

a demand valve;

an operative connection between the demand valve and the gas flow path;

a supply of breathable gas; and an inlet flow conduit operatively connected to the demand valve and adapted to be so connected to said supply of breathable gas, whereby such gas may flow along the inlet flow conduit, through the demand valve and connection, and into the gas flow path, at a rate determined by the demand valve.

5. An apparatus according to claim 1 or 4, wherein the supply of breathable gas is a supply of oxygen and wherein a first shut-off valve is provided for disconnecting the supply of oxygen to the demand valve and wherein a second shut-off valve is provided which controls a conduit between the inflatable breathing bag and a supply of an oxygen/helium mixture included in the apparatus separate from the supply of oxygen, so that, in use, an initial descent from the surface can be accomplished with the first shut-off valve open and the second shut-off valve closed to allow oxygen from the supply of oxygen to be inhaled and then, when the partial pressure of the oxygen is too great for breathing or at a predetermined depth, the first shut-off valve can be closed to discontinue the oxygen supply and the second shut-off valve can be opened to admit the oxygen/-helium mixture into the inflatable breathing bag at a steady rate of supply, exhalation and inhalation then being to and from the inflatable breathing bag with oxygen deficiencies being replenished by the supply of the oxygen/helium mixture to the inflatable breathing bag, the sequence of operation being reversed on ascent.

6. An apparatus according to claim 5, wherein there is provided a third shut-off valve which controls a conduit between the oxygen/helium supply and the demand valve so that, during descent, and immediately after the clsoing of the first shut-off valve to discontinue the supply of oxygen, the third shut-off valve can be opened with the control valve in the second position to allow the oxygen/helium mixture to be breathed through the demand valve and exhaled through the exhaust valve, and then, at a predetermined depth, the third shut-off valve being closed, the control valve being moved to the first position and the second shut-off valve being opened to allow breathing through the breathing bag, with the oxygen/helium mixture supplied to the breathing bag replenishing oxygen deficiencies.

7. An apparatus according to claim 6 wherein one or more of the shut-off valves are operated by hydrostatic pressure at a predetermined depth.

8. An apparatus according to claim 5 or claim 6, wherein the connection controlled by the second shut-off valve includes a device which so controls the supply of the oxygen/helium mixture to the breathing bag that, when the second valve is open, a correctly constituted breathable mixture is maintained in the breathing bag for the depth at which the diver is working.

9. An apparatus according to claim 8 wherein the device is a constant mass flow valve.

10. An apparatus according to claim 5, wherein one or more of the shut-off valves are operated by hydrostatic pressure at a predetermined depth.

11. An apparatus according to claim 5, wherein the connection controlled by the second shut-off valve includes a device which so controls the supply of the oxygen/helium mixture to the breathing bag that, when the second valve is open, a correctly constituted breathable mixture is maintained in the breathing bag for the depth at which the diver is working.

12. An apparatus according to claim 1 or 4, said demand valve including a chamber and a diaphragm, said diaphragm dividing said chamber into a first section and a second section, a needle valve being connected to said diaphragm in said first section and normally closing said connection between said inlet flow conduit and said gas flow path, a conduit connecting said mouthpiece to said second section, whereby under normal operating conditions said needle valve closes said connection between said inlet flow conduit and said gas flow path and when pressure in said mouthpiece and said second section is reduced below a predetermined value, said needle valve is opened to supply said breathable gas to said gas flow path.

13. An apparatus according to claim 12, wherein said first section includes a spring to bias said needle valve to the open position when the pressure in said second section is reduced below said predetermined value.

* * * * *